US006639507B1

(12) United States Patent
Tubaltsev et al.

(10) Patent No.: US 6,639,507 B1
(45) Date of Patent: Oct. 28, 2003

(54) PLATED PRECISION POTENTIOMETER

(76) Inventors: Vladimir Tubaltsev, 3623 Fountain Dr. #4, Louisville, KY (US) 40218; Aleksandra Tubaltseva, 3623 Fountain Dr. #4, Louisville, KY (US) 40218

( * ) Notice: Subject to any disclaimer, the term of this patent is extended or adjusted under 35 U.S.C. 154(b) by 0 days.

(21) Appl. No.: 10/133,280

(22) Filed: Apr. 29, 2002

(51) Int. Cl.[7] ..... H01C 10/30

(52) U.S. Cl. ..... 338/160; 338/176; 338/157; 338/202; 338/DIG. 1

(58) Field of Search ..... 338/157, DIG. 1, 338/176, 160, 202

(56) References Cited

U.S. PATENT DOCUMENTS 2,329,949 A * 9/1943 Shapiro ..... 338/160
2,523,896 A * 9/1950 Bartolomei ..... 338/157
2,537,671 A * 1/1951 Jack et al. ..... 338/157
2,868,933 A * 1/1959 Singelman ..... 338/157
2,870,304 A * 1/1959 O'Brian ..... 338/176
2,993,184 A * 7/1961 Mims et al. ..... 338/157
3,123,793 A * 3/1964 Flygstad et al. ..... 338/160
3,456,228 A * 7/1969 Wright ..... 338/176
4,045,765 A * 8/1977 Imamura ..... 338/176
4,596,949 A * 6/1986 Faye et al. ..... 323/359

FOREIGN PATENT DOCUMENTS

JP 406112016 * 4/1994 ..... 338/160

* cited by examiner

*Primary Examiner*—Karl D. Easthom

(57) ABSTRACT

A plated precision potentiometer (PPP), consists of resistance plates, disc, a screw, springs and a cylinder to enclose all moving parts. The PPP will produce a resistance determined by the location of the disc on the plates. The disc will travel on the screw; the change in location of the disc will adjust the resistance value proportionally to the distance it travels.

12 Claims, 6 Drawing Sheets

SECTION A-A

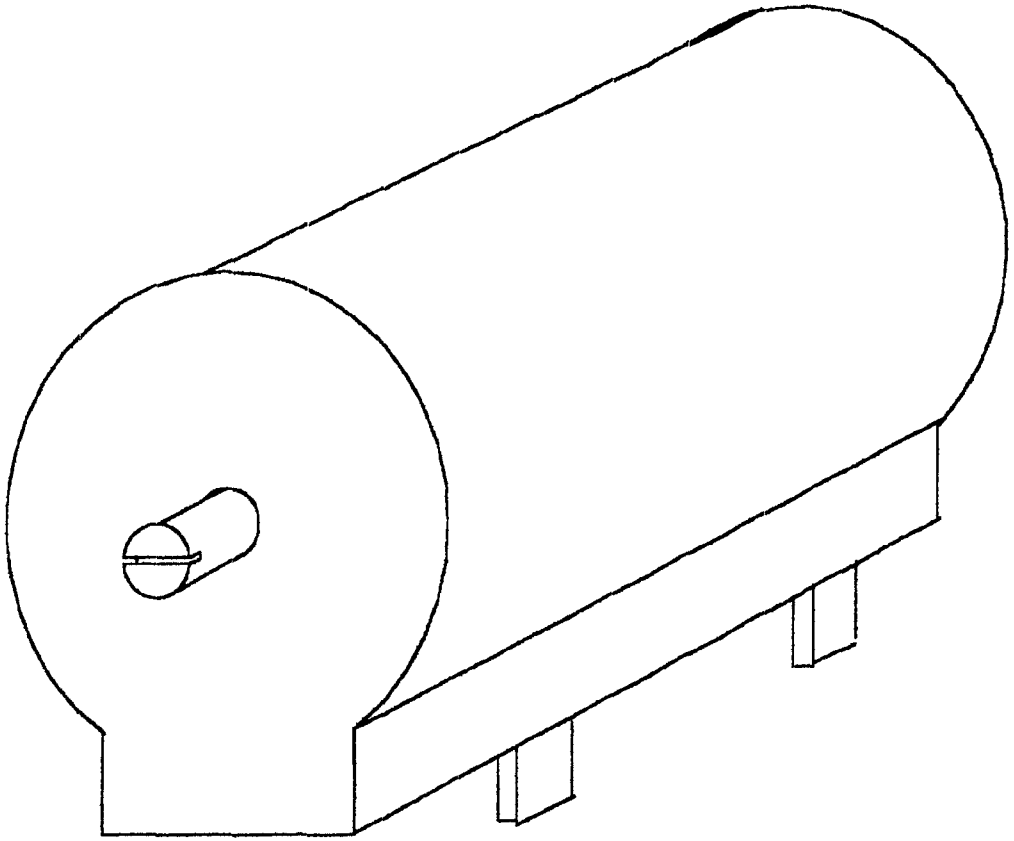
FIG#1

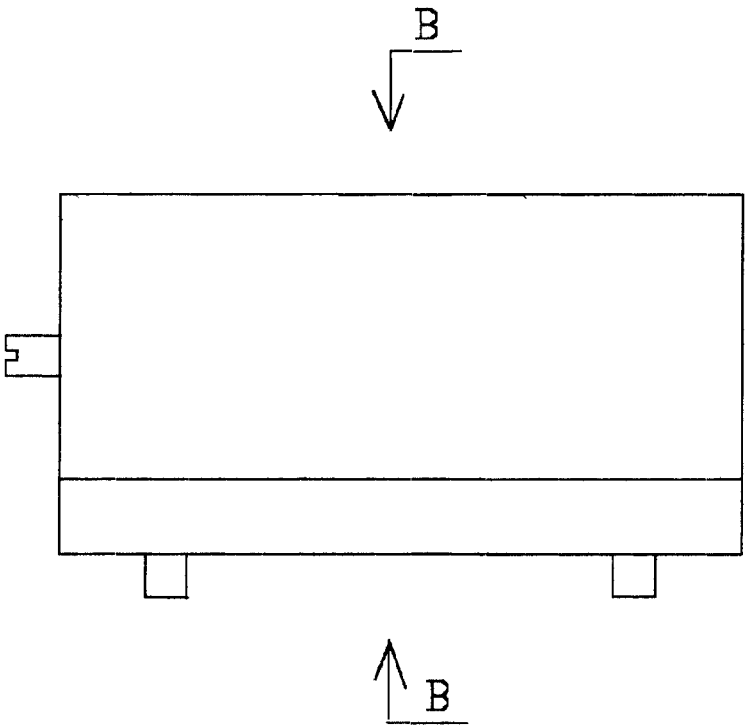
FIG#3
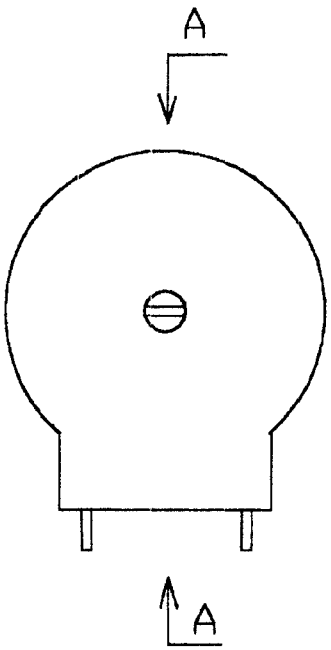
FIG#2

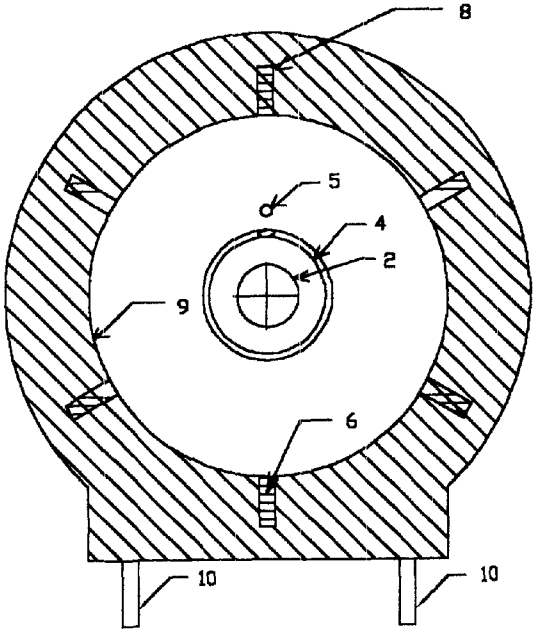
SECTION B-B
FIG#5
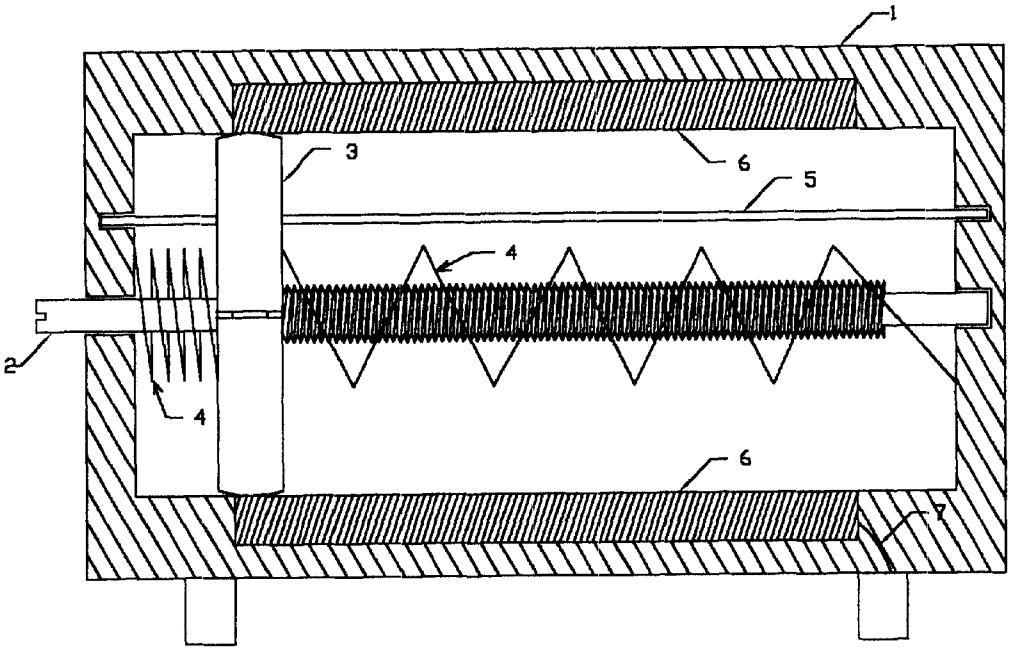
SECTION A-A
FIG #4

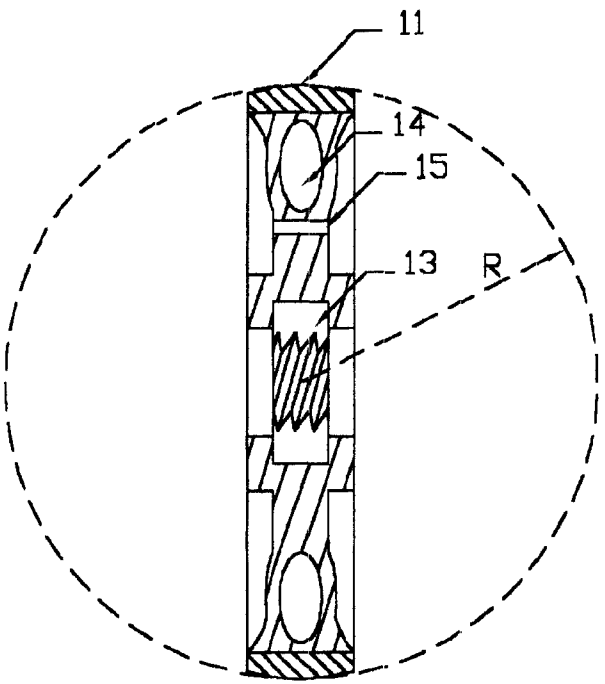
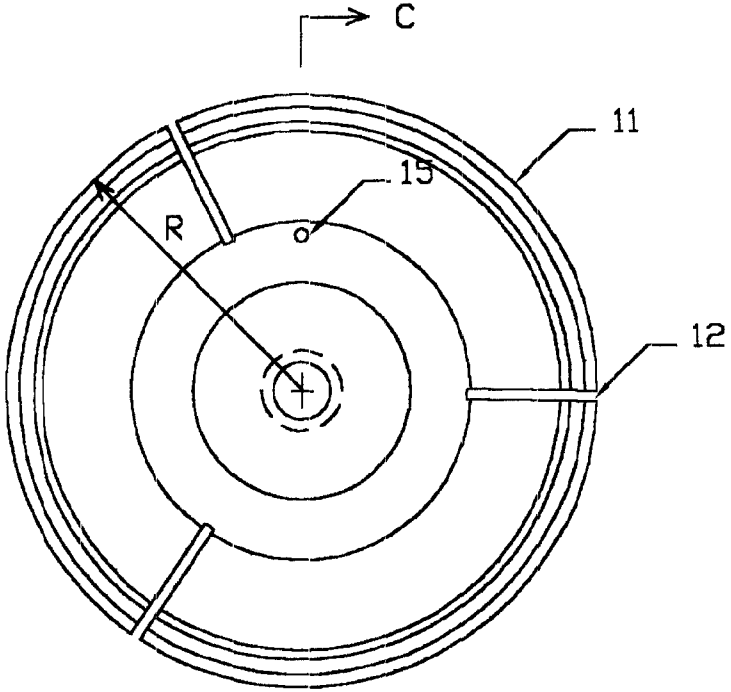
FIG#6

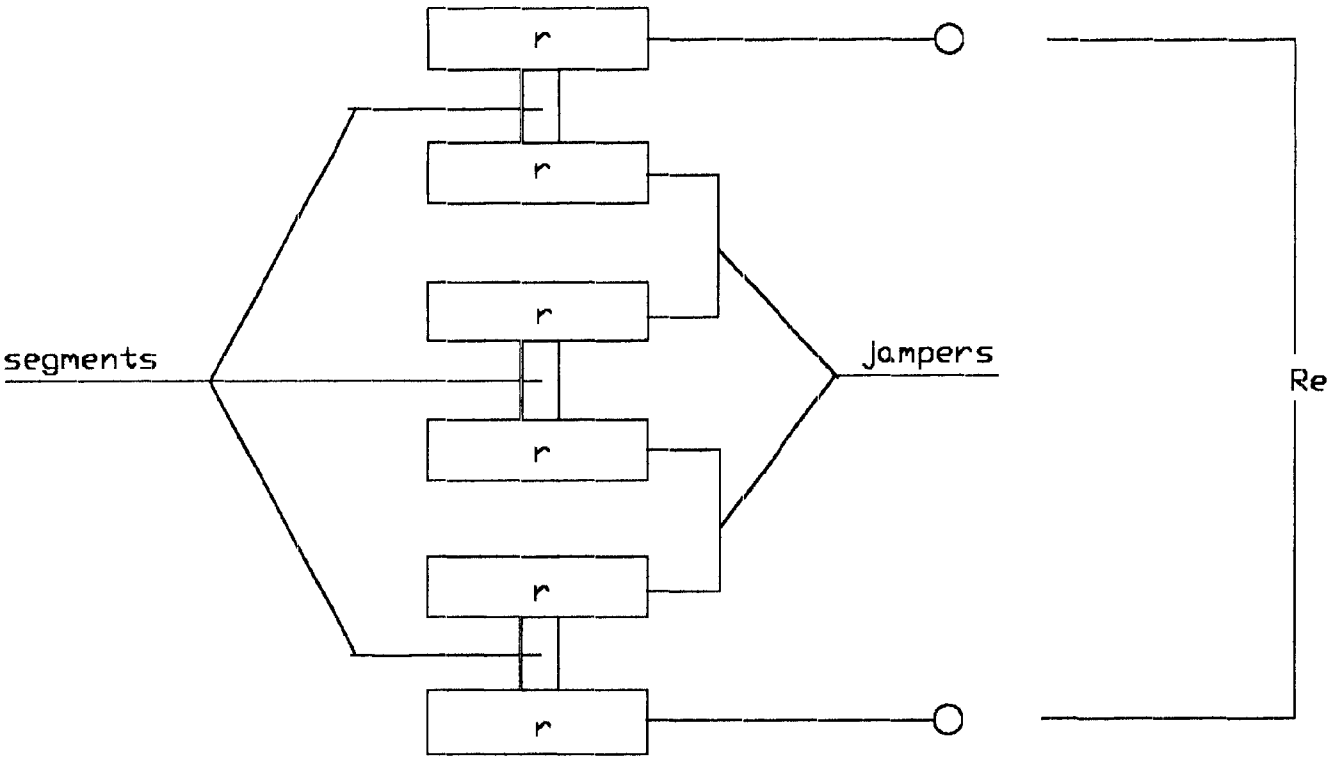
Re = r+r+r+r+r+r ,
where r- resistor one plate.
FIG#7

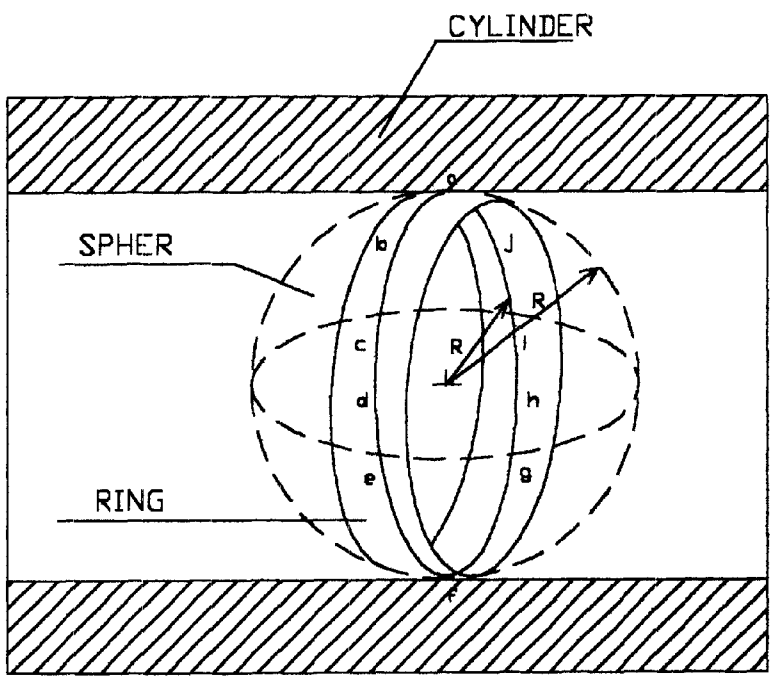
B)
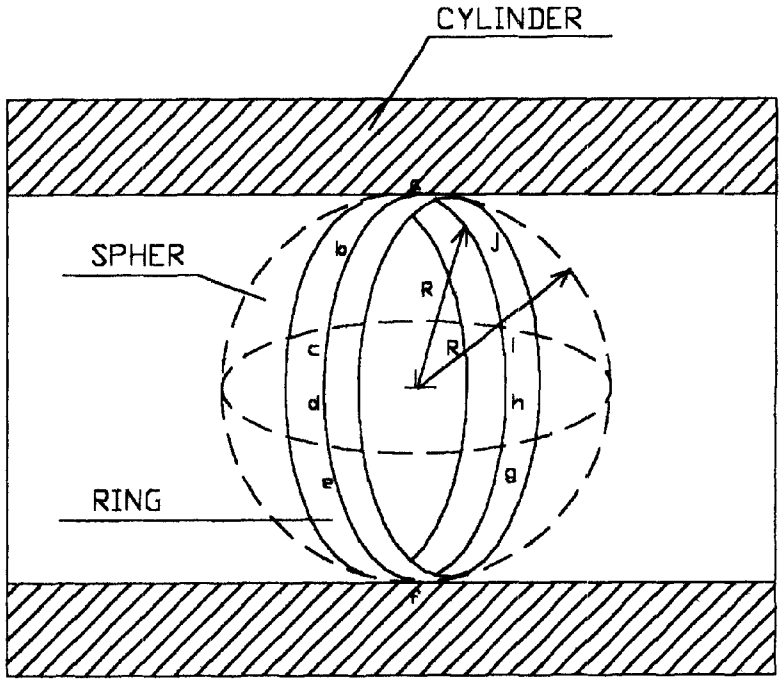
A)
FIG#8

PLATED PRECISION POTENTIOMETER

BACKGROUND OF THE INVENTION

The potentiometer is used to control variable electrical resistance. PPP is to be used in various fields of technology where electrical or electronic devices are used. For instance: in systems of control or regulation, in automatic systems of control or regulation, in measuring devices, or in radio technical devices (to choose radio frequency). The size of the potentiometer depends on the application; they have a moving piece that could be rotated or placed in the proper place to adjust the resistance.

BRIEF SUMMARY OF THE INVENTION

The potentiometer is a highly accurate mechanical device that will be very valuable in today's technological field. It possesses such qualities as 1% accuracy, a lifespan of 1000 cycles or more, and stability in industrial vibrations.

Today's potentiometers do not have the qualities needed to fulfill the full realm of their work. And that is what led us to the idea of constructing a potentiometer that has all the needed parameters.

BRIEF DESCRIPTION OF THE DRAWINGS

The drawings associated for this invention show all parts required to complete the entire device. All components are numerically designated to further explain in detail the specified invention.

FIG. #1 is a general view of the potentiometer assembly,

FIG. #2 is a left elevation of the potentiometer,

FIG. #3 is a front elevation of the potentiometer,

FIG. #4 is a section A—A,

FIG. #5 is a section B—B,

FIG. #6*a* is a plan view of the disc,

FIG. #6*b* is a section C—C of the disk,

FIG. #7 is an electrical schematic connection of the resistance plates,

FIG. #8*a* the points of contact between the sphere and the cylinder,

FIG. #8*b* the points of contact between the sphere and the cylinder don't change if the sphere is rotated within the cylinder.

DETAILED DESCRIPTION OF THE INVENTION

The above-proposed Plated Precision Potentiometer (PPP) is intended for a high accuracy transformation of the angle of rotation into proportional electrical resistance. This leads to a practically new original design of the PPP. The originality of the proposed design consists of that the basic idea: the use of the properties of points of contact of two figures of a sphere placed in to a cylinder. From mathematics it is known, that all points of contact of these figures will be on the circumference, and that this circumference will be in the plane perpendicular to the axis (and the walls) of the cylinder. Moreover in any position of the sphere inside the cylinder (displacement along the axis of the cylinder, rotation) the plain, in which lies the circumference made from the points of contact, will always be perpendicular to the axis of the cylinder.

Since unsanctioned movement of the parts of PPP is limited, then instead of the sphere in the design is used only a ring which is cut from a sphere. See FIG. #8.

The use of this property in the design of PPP allows the use of resistance plates with equal/same geometrical measurements, with the equal/same electrical resistance.

On FIG. #1 you can see the general view of the potentiometer. In the body 1 of the potentiometer is a cylindrical opening 9. In the slit 8, made in the walls of the cylinder, are placed the resistance plates connected together by the schematic provided in FIG. #7 and attached to contacts 10. Inside the cylinder is placed a disc 3, which moves along the axis of the cylinder with the rotation of the screw 2. For the elimination of free movement in the fretwork connection between the disc and the screw, are used two springs 4. In order to eliminate the possibility of rotation of the disk around the axis there is a steel rod 5 passing through an opening and affixed into the walls of the potentiometer.

The most important and complicated part of the potentiometer are the disks 3, then lets look at the design more closely. The disk consists of a plastic body in the center of which is placed a steel nut 13. Close to the diameter of the disk inside the body of the disk is placed a plastic circular tube spring 14. On the outer side of disc put on a copper ring. From FIG. #6 you can tell, that radius of the ring FIG. #6A, and the radius of the ring in FIG. #6B are the same, this means that the rings is cut from a sphere. After the assembly of the disc, in its body are made slits 12, in the direction of the radius, which divide the ring into three electrical non attached segments 11, which also divide the round tube spring into three parts, then for every segment there will be its own plastic tube spring. These springs provide high quality reliable electric contact between the segments, and the resistance plates, and the long lifespan of the potentiometer.

This design of the potentiometer guarantees a perpendicular plane, which has the points of contact of the resistance plates, the axis of cylinder, in any position of the disc. This means that in measuring of the electrical resistance will be used equal parts of the plates, then the mechanical error of the potentiometer will practically equal zero. This guarantees high accuracy transformation of the angle of rotation into proportional electrical resistance.

In manufacturing PPP are used the following materials:

| PART | MATERIAL |
|---|---|
| 1-Body | Plastic |
| 2-Screw | Steel |
| 3-Disc | Copper, plastic, steel |
| 4-Springs | Steel |
| 5-Rod | Steel |
| 6-Resistance Plates | Carbon or another resistance material |
| 7-Wire | Copper |
| 10-Legs (contacts) | Copper |

The amount of plates is limited only by the size of the plates and PPP. For simplicity drawings of the design of PPP are used only 6 plates.

What is claimed is:

1. A Plated Precision Potentiometer (PPP) comprising: a housing with a cylindrical opening within the walls of which are placed, parallel to the axis of the cylindrical opening, 6 rectangular plates made out of resistance material, a disc inside said housing through the center of which is a screw, as the screw rotates the disc moves along it and along the axis of the cylindrical opening, the diameter of the disc is equal to the diameter of the cylindrical opening, on one side of the disc is a contact ring which has the radius equal to the radius of the disc and the radius of the opening within the body of PPP, the movement of the disc along the axis of PPP is restricted by lids on both sides of the housing of cylindrical housing, the screw is attached to the lids in the cylinder and goes through the center of the disc, which does not allow the cylinder to rotate around the axis of the cylinder when the screw is rotating, springs are between the disc and the lids of the cylinder which guarantees the movement of the disc along the axis of the cylinder without a free movement when the direction of the movement of the disc is changed, the contact ring is made from an electrically conductive material, which is on one side of the disc, and cut into three equal parts or segments, which guarantee a paired electrical contact of the resistor plates, all points of contact of the segments and the resistor plates will always be in the same plain and perpendicular to the axis of the cylinder, 4 legs are along the body of the housing, and serve as a connection mechanism of the PPP to any circuit and two of said legs are used to connect the PPP to an electrical schematic, wherein the movement of the disc from one end of the PPP to the other causes the electrical resistance to be proportional to a change from 0 to Rmax, or from Rmax to 0 from the reversed movement of the disc, and the electrical resistance output has a linear characteristic.

2. The Plated Precision Potentiometer of claim 1 having resistor plates placed into the housing of the PPP parallel to the axis of the cylinder and placed along an equal distance from the axis which is equal to the radius of the cylindrical opening within the body of PPP, all the plates being the same size and having an equal electrical resistance.

3. The Plated Precision Potentiometer of claim 1 having the disc placed within the cylindrical opening in the housing of PPP wherein the body of the disc made from an insulative material, in the center of the body of the disk is a steel rod intended for the use of the movement of the disc along the axis of PPP, on one of the sides of the disc is attached said contact ring which is made from a conductive material, between the contact ring and the body of the disc is a circular plastic spring, after the assembly of the disc the contact ring and the circular plastic spring are cut, toward the direction of the radius, into three parts or segments, such that each segment has its own plastic spring, which guarantees reliable contact between the pair of the resistor plates and the segment, and also elevates the longevity of PPP and the resistance of PPP to vibrations, and within the body of the ring is an opening for the rod which restricts the rotation of the disc around the axis when the screw is rotating while moving the disc along the axis of PPP.

4. The Plated Precision Potentiometer of claim 1, such that when the equality of the radius of the roundness of the contact ring, Rcurve, the radius of the disc, Rdisc, and the radius of the cylindrical opening within the body of PPP, Rcylinder, are such that the equation Rcurve=Rdisk=Rcylinder is true, all the points of contact of the contact ring with the walls of the cylindrical opening in the body of PPP forms a circumference of radius Rcylinder in the plain perpendicular to the axis of the cylindrical opening, and only when the equation is completed is one able to use N amount of resistor plates where N=2, 3, . . . C where C a constant number which is only restricted by the size of the resistor plates and the size of the potentiometer.

5. The Plated Precision Potentiometer of claim 1 such that during movement along the axis of the PPP all points of contact of the segments and the resistor plates always, at any point of the disc on the axis of PPP, will be in the same plain perpendicular to the axis of the cylindrical opening within the body of PPP, thus in the measurements of the PPP will be used equal parts or segments of the resistor plates with an equal electrical resistance, the measurements of resistance will be Ri=ri1+ri2+ri3+ri4+ri5+ri6 where ri1; ri2; ri3; ri4; ri5; ri6 are electrical resistance parts of the electrical plates at I-point; i=1,2,3 . . . 6 points of the placement of the disc on the axis of PPP.

6. A potentiometer:

the potentiometer having a disc contact, the disc contact having a periphery of radius a, the periphery of the disc contact defining and having a curved surface with a radius of curvature of radius a, as the disc is viewed from a cross sectional slice through its diameter.

7. The potentiometer of claim 6 wherein the disc moves in a linear manner.

8. The potentiometer of claim 6 wherein the disc is inside a cylindrical housing and travels in a longitudinal axis thereof.

9. The potentiometer of claim 6 wherein the curved surface is formed of a copper ring.

10. The potentiometer of claim 6 wherein the housing has one or more resistive strips parallel to the longitudinal axis, and the disc contact slides along said resistive strips.

11. The potentiometer of claim 6 wherein the housing has three resistive strips parallel to the longitudinal axis, and the disc contact has three corresponding sections and slides along said resistive strips.

12. The potentiometer of claim 11 wherein the disc has a circumferential spring inside.

* * * * *